US005779346A

United States Patent [19]

Burke

[11] Patent Number: 5,779,346

[45] Date of Patent: Jul. 14, 1998

[54] ELECTROLUMINESCENT DEVICE WITH A SECURE CONTACT

[75] Inventor: David M. Burke, Grand Blanc, Mich.

[73] Assignee: Dynamic Brilliance Corporation, Goodrich, Mich.

[21] Appl. No.: 658,606

[22] Filed: Jun. 5, 1996

Related U.S. Application Data

[62] Division of Ser. No. 413,784, Mar. 30, 1995, abandoned.

[51] Int. Cl.[6] ..... F21V 9/16

[52] U.S. Cl. ..... 362/84; 362/226; 362/806; 362/812; 40/544; 313/503; 313/509

[58] Field of Search ..... 362/84, 226, 806, 362/812; 40/544; 313/509, 513, 503, 510

[56] References Cited

U.S. PATENT DOCUMENTS

| | | | |
|---|---|---|---|
| 3,310,703 | 3/1967 | Brooks | 313/506 |
| 4,645,970 | 2/1987 | Murphy | 40/544 X |
| 4,733,488 | 3/1988 | Yokoyama et al. | 40/544 |
| 5,572,817 | 11/1996 | Chien | 40/544 |
| 5,598,058 | 1/1997 | LaPointe | 313/509 X |

*Primary Examiner*—Stephen F. Husar

*Attorney, Agent, or Firm*—Joseph W. Molasky & Associates

[57] ABSTRACT

An electroluminescent night light which provides a single color or multi-colored display. The display is achieved by depositing, onto a conductive layer by screen printing means, a single film or one or more discrete phosphor characters of the same or different color. Also included is a novel construction feature, specifically, a 'wrap' around means for securely joining the electroluminescent lamp to the plug assembly.

17 Claims, 5 Drawing Sheets

FIG. 3
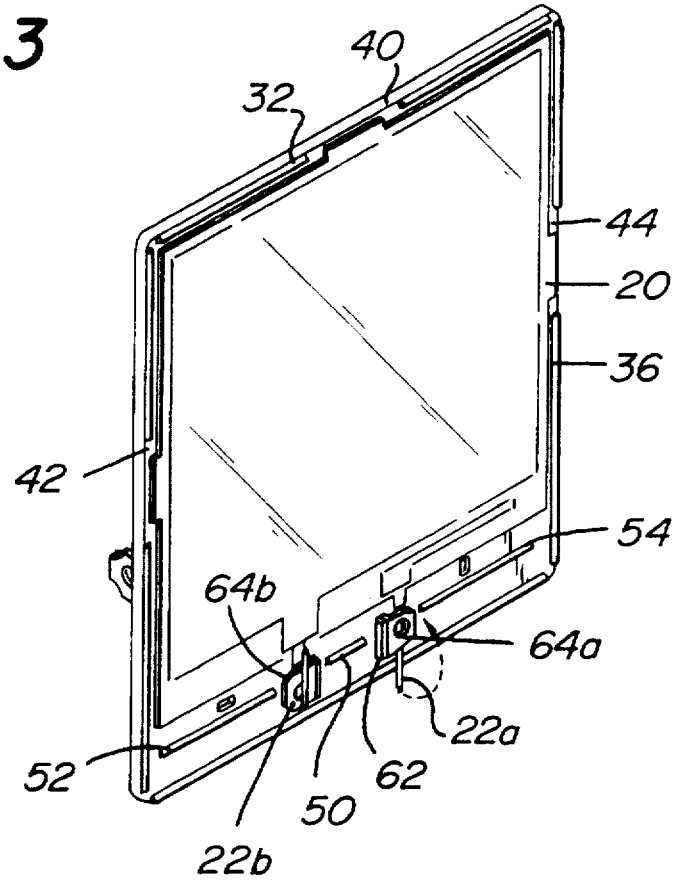
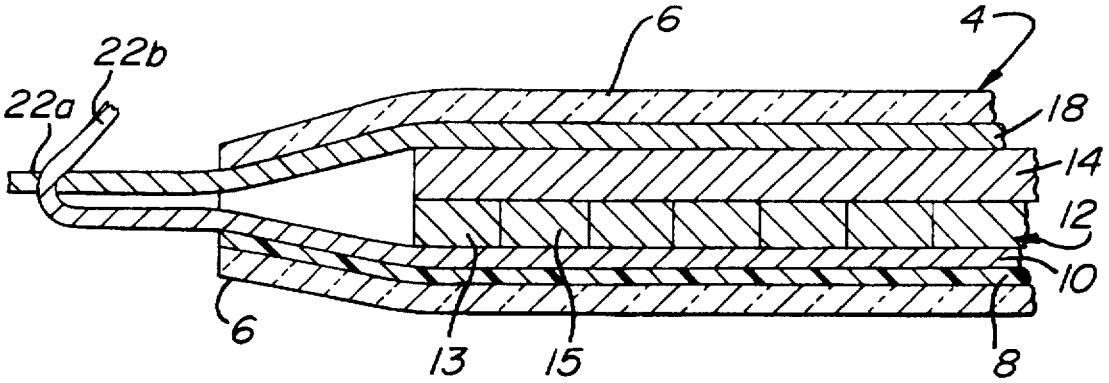
FIG. 7

ELECTROLUMINESCENT DEVICE WITH A SECURE CONTACT

This application is a Division of application Ser. No. 08/413,784 filed Mar. 30, 1995, now abandoned.

This invention relates to an electroluminescent night light containing discrete phosphor characters which can be illuminated to create a picture, design, or message.

When used in this manner, the night light affords not only a modicum of light, but it also provides an aesthetically attractive display, or furnishes a message.

Alternatively, the night light may contain no characters or display whatsoever and, instead, it may simply provide a uniform glow and perform as any other night light. When used in this manner, the night light may warn of a hidden danger or it may be used near a child's bed to brighten the room.

The night light of this invention is also characterized by a novel structure including a unique joining means for producing a secure connection between the lamp per se and its plug assembly.

This joining means is achieved by a 'wrap around' feature which permanently joins the connecting pins of the electroluminescent lamp with the blades of the plug. This is accomplished in a single step and without any compressible adjunct as, for example, gaskets, rubber shims, or the foam inlays which are found in conventional assemblies.

BACKGROUND OF THE INVENTION

An electroluminescent lamp is essentially a phosphor film disposed between electrodes, at least one of which is transparent and energized to a state of luminescence by the introduction of electrical energy.

The phosphors are deposited onto an anode such as indium tin oxide impregnated onto a support such as polyethylene.

The phosphors are always in contact with the anode on one side and with a dielectric composition, such as barium titanate, on the other. The cathode is usually silver deposited onto a polyester substrate.

In such a lamp, the phosphor film and the silver film have the same dimension and when the system is energized, the electroluminescent device emits a uniform glow.

In this system, no design, message, or display is intended because the silver and the phosphors are applied continuously as unitary films and no discrete characters are formed.

One drawback to known night lights is the premature failure of their plug assemblies.

In known night lights, the electrical connection between the EL lamp and the male plug is usually achieved by a stamping step which affords only a tenuous connection so that over a period of time, the resulting connection disassembles and the system fails.

SUMMARY OF THE INVENTION

It is an object of this invention to describe an electroluminescent night light in which discrete characters may be illuminated to provide a message or create an aesthetically pleasing display. To achieve this result, screen printing is used to lay down the phosphor characters in selected areas so as to provide an image or message.

Another object is to provide an electroluminescent lamp in which the individually displayed characters are multicolored. To achieve this effect, a plurality of screen printing passes are performed each with a separate color. Since any number of passes may be made, the resulting lamp will have the appearance of a multicolored display.

Still another object is to provide an electroluminescent lamp in which connector pins are joined to a male plug in such manner as to create an electrical connection which is superior to that of known devices.

This is accomplished through a series of steps in which an electroluminescent panel is mated to a front plate and a rear support plate. The panel includes a substrate coated with a first conductive layer that extends outwardly to the peripheral edges of the substrate followed by successive deposits of a phosphor layer, a dielectric layer, and a second conductive layer.

Once these layers have been put down, a pin is electrically connected to the first conductive layer and a second pin is electrically connected to the second conductive layer.

The panel is then positioned onto a rear support plate having slots through which the blades of a male plug are inserted. Each blade has a projection integrally formed at its front end which extends generally perpendicular to the blades. Each pin of the panel is positioned between the front side of the support plate and blade projections or extensions. In an alternative embodiment, the pins are wrapped around the blade to produce a more secure contact.

The front plate is loosely joined to the support plate and the resulting assembly is placed onto a welding bed while the front plate is in contact with a rubber insert. A welding horn is then pressed onto the rear surface of the support plate and this results in greater uneven pressure being brought to bear on the rubber insert due to the presence of the pin and blade. And because the welding horn is hard and rigid and the insert is soft and flexible, the nest compresses in the area between the blade extensions so that as a result of the welding step, the support plate becomes contoured in a convex manner immediately above the blade extensions. The result is a secure electrical contact between each pin and each blade.

These and other aspects of the invention will be better understood by making references to the drawings.

BRIEF DESCRIPTION OF THE DRAWINGS

FIG. 3 is a perspective view of the panel assembled on the support plate of the electroluminescent device.

FIG. 7 is an enlarged partial cross-sectional view of the electroluminescent device.

DETAILED DESCRIPTION OF THE INVENTION

Figure 1:
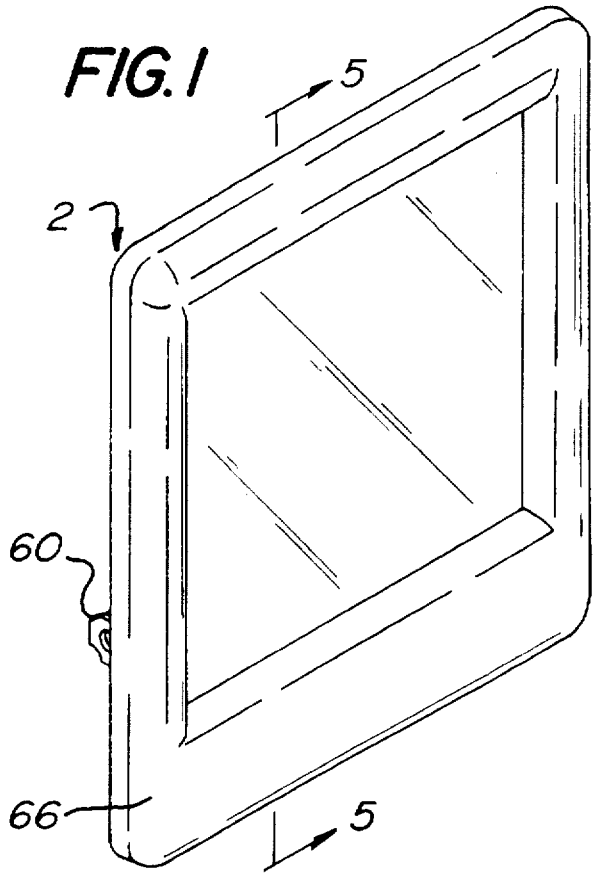
FIG. 1 is a front perspective view of the electroluminescent device of this invention.

Referring to FIG. 7, the electroluminescent device 2 (FIG. 1) comprises a panel 4 that has an outer water impervious envelope 6 which encases the layers of materials as shown.

The envelope 6 is composed of a transparent plastic material generally known as ACLAR and has a thickness of approximately 0.003–0.006 inches. A polyester film 8 having a thickness of 0.005 inches is disposed on a portion of the envelope 6. An anode layer 10 composed of an indium tin oxide coated on a polyethylene terephthalate substrate is then deposited on the polyester film 8 and extends outwardly to the peripheral edges of the substrate.

Figure 4:
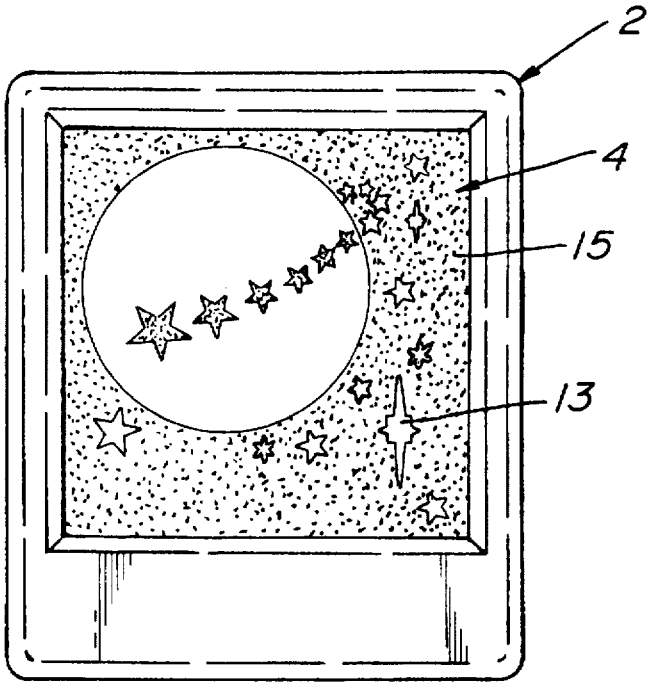
FIG. 4 is a front perspective view of the electroluminescent device in its assembled form shown with a multicolored display.

A phosphor layer 12 is then deposited on the anode layer 10 by screen printing using two passes. This procedure is accomplished by producing a film positive in which the design consists of discrete characters, for example, a plurality of stars. This design is then deposited onto the screen. One pass is performed on the film with a phosphor material of a particular color. Then, another film positive is produced with the discrete phosphor characters illustrating the background of the design. The background of the design is then deposited onto the screen and a pass is performed with a phosphor material of a different color. The phosphor characters are positioned in each pass such that they are spaced apart or overlap very slightly from the adjacent characters so that each character can be displayed substantially in its entirety. Thus, when the device 2 is energized upon plugging it into an outlet, that design is illuminated depicting the discrete phosphor characters 13 of one color and the phosphor characters 15 of another color as shown in FIG. 4.

It should be noted that multiple film positives can be produced depicting other designs for electroluminescent devices with the design of each film being deposited onto the screen for printing so that a pass can be performed on other discrete characters with a different type of phosphor corresponding to a different color. During printing, any number of selectively applied phosphor passes with different color phosphors can yield a variety of designs having multicolored characters and backgrounds. AS previously stated, when performing each pass, the phosphor characters are positioned such that they are spaced apart or overlap very slightly from their adjacent characters so that each character can be displayed in its entirety. Hence, this process can give the appearance of one continuous multicolored scene or design. For example, one pass can be made to show a blue star, another pass can be made to show a green circle, and another pass can be made to show a yellow background on the electroluminescent device. It should further be noted that the electroluminescent device may illuminate only one color by applying only one pass of one type of phosphor.

The phosphor layer 12 and anode layer 10 are intimately joined and their respective layers are identically sized so that they possess the same surface dimensions and share common boundaries. After the phosphor layer 12 is deposited, a dielectric 14 composed of a solid, ceramic, inorganic material such as barium titanate is deposited on the phosphor layer 12. A cathode layer 18 composed of 80–90% silver and 10–20% polyester is then deposited on the dielectric 14. This cathode layer 18 is generally white in appearance. The other outer portion of the envelope 6 covers the cathode layer 18. The edges of the envelope 6 are heat swaged together forming a seal having a minimum of 1/16 inches wide with the minimum edge to phosphor distance of 3/16 inches. The envelope may further include tabs 20 extending from each of the edges as seen in FIG. 2.

A flexible elongated pin **22*a* generally composed of beryllium copper and having a thickness of 0.004 inches is electrically connected to the anode layer 10 and another similar pin 22*b* is electrically connected to the cathode layer. The pins 22*a* and 22*b* are generally parallel and coplanar with respect to each other as shown in FIG. 2**.

Figure 6:
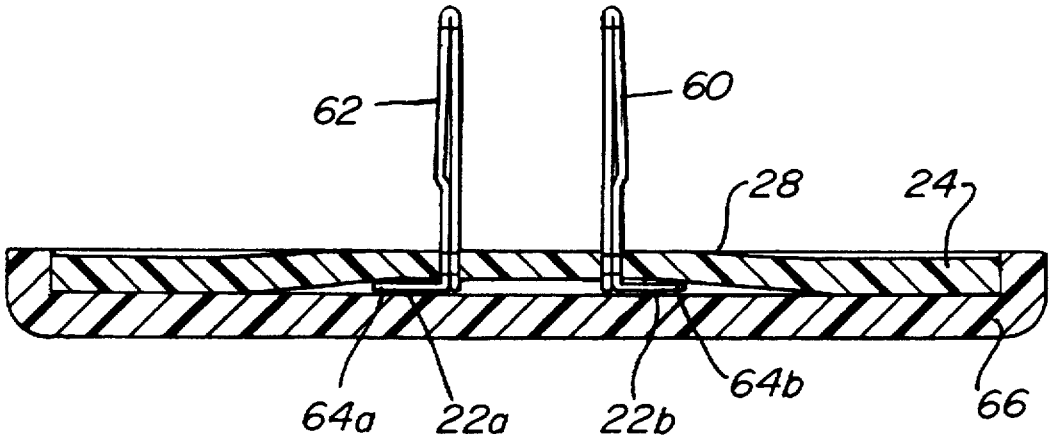
FIG. 6 is a sectional view of the electroluminescent device taken along line 6—6 of FIG. 5.
Figure 8:
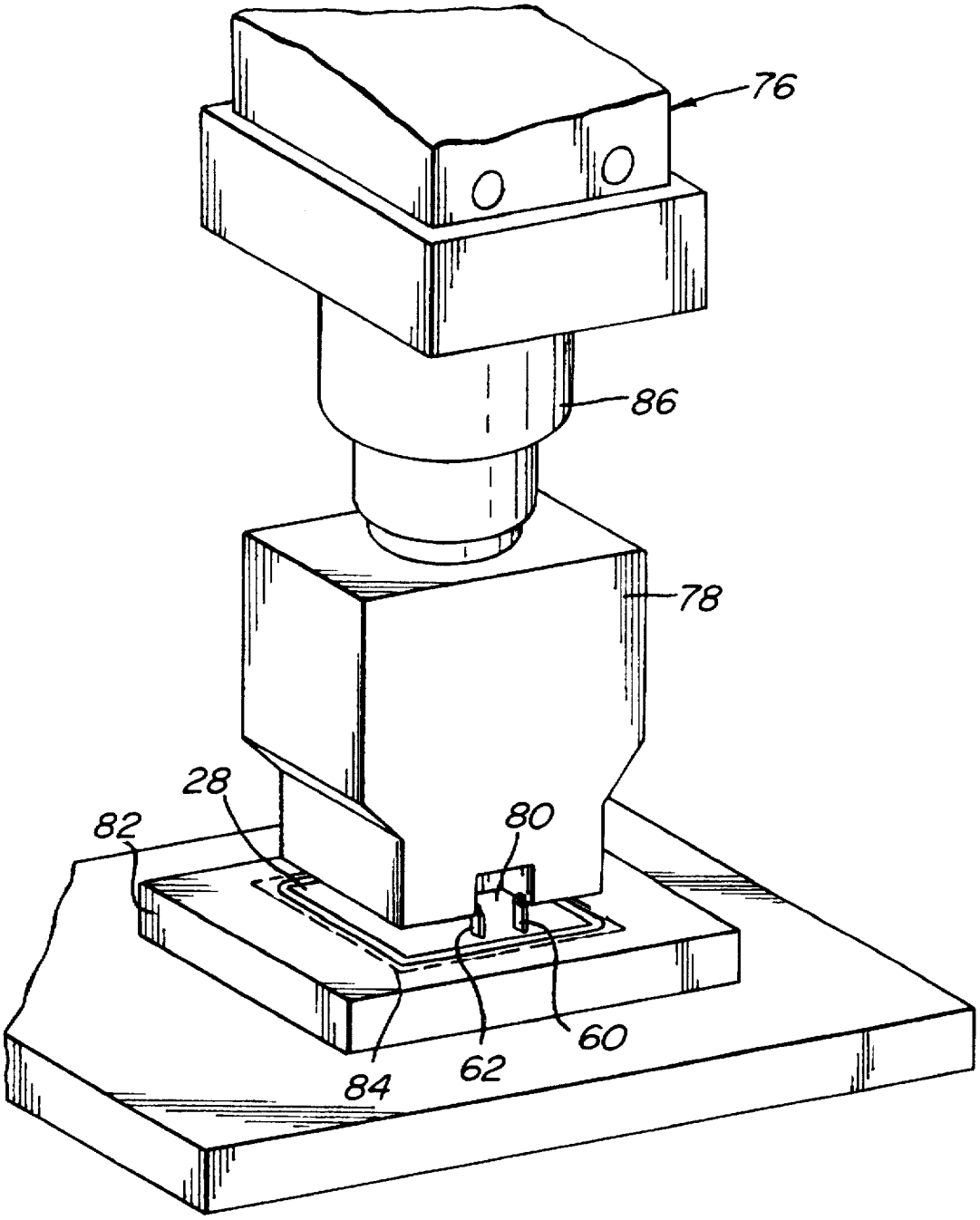
FIG. 8 is a perspective view of the welding apparatus employed in the manufacture of the present device.

The invention further includes a support plate 24 (FIGS. 2 and 3) having a front surface 26 and a rear surface 28 (FIGS. 6 and 8). The front surface 26 has ridges 30, 32, 34, 36 outlining the support plate 24 near its edges. The top and side ridges 32, 34, 36 each have a center opening 40, 42, 44. The support plate has a pair of identical slots 46 just above the bottom ridge 30. A square recess 48, 49 is formed corresponding to each slot 46. Each slot 46 is located at the inner edge of its respective square recess. A central ridge 50 parallel to the bottom ridge 30 is formed between the slots. A left ridge 52 is formed between the left slot 46 and left side ridge 34, and a right ridge 54 is formed between the right slot and right side ridge 36. These three ridges 50, 52, 54 are generally collinear. A recess 56 is formed just above the center of the left ridge 52 and another recess 58 is formed just above the center of the right ridge 54.

Figure 2:
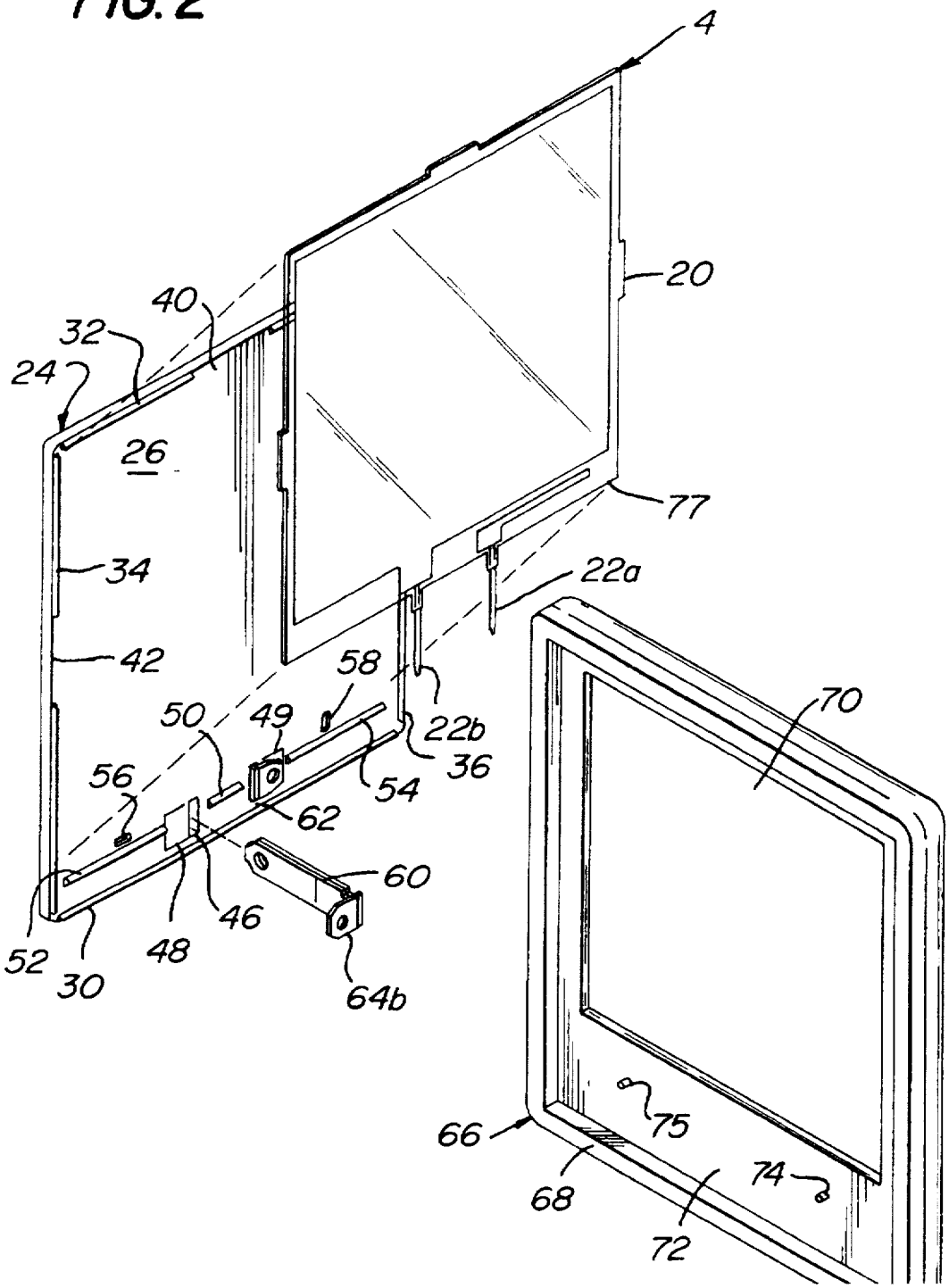
FIG. 2 is an exploded view illustrating the various elements of the electroluminescent device.

A plug having a pair of blades 60,62 is then inserted through the slots as depicted in FIG. 2. Each blade has a front extension **64*a*, 64*b*** that extends outwardly at right angles with respect to the blade and overlies its respective recess.

Referring to FIG. 3, the panel 4 is then positioned upon the front surface 26 of the support plate 24 with the anode layer 10 facing the front surface. The tabs 20 are fitted through the openings 40,42, 44, and the pins **22*a*, 22*b* are slid underneath and then wrapped around the extensions 64*a*, 64*b*. The extensions 64*a*, 64*b* and pins 22*a*, 22*b* are pressed into their respective recesses such that they are pinched between the extensions. It should be noted that the pins 22*a*, 22*b* need not wrap around the extensions. A portion of each of the extension 64*a*, 64*b*** extends out of the rim of its respective recess.

Referring to FIG. 2, the invention further includes a front plate 66 having an outer frame 68, cut-out portion 70, and inner portion or ledge 72. The inner portion 72 has a pair of protrusions 74, 75 on the bottom side for a cooperating fit into the recesses 56, 58 of the panel 4. The support plate 24 is then placed on the inner portion 72 such that the protrusions 74, 75 mateably engage the recesses. The bottom edge 77 of the panel will abut against the protrusions that function as stops to prevent the panel from sliding towards the extensions and disconnecting the electrical contact between the extensions and pins. The support plate 24 extends slightly out of the rear surface of the outer frame at the area between the extensions **64*a*, 64*b***.

The next step is to sonic weld the assembly. Referring to FIG. 8, the invention includes a welding tool 76 comprised of a steel welding horn 78. The horn has a cut-out portion 80 having the same width as the distance between the outer edges of the two slots. The tool further includes a flexible, elastic rubberized welding nest 84. The horn 78 is fastened to a movable part 86 of the welding tool 76 and the welding nest 84 is affixed to the bed 82 of the welding tool 76.

The assembled electroluminescent is then placed on the welding nest 84. The front surface of the front plate 66 is inserted face down into the rubberized welding nest 84.

The horn 78 is positioned on the rear surface 28 of the support plate 24 such that the cut-out portion of the horn 78 is aligned over the blades 60, 62. During welding, the horn 78 applies uneven pressure to the soft rubber nest 84 since the area between the slots is thicker than the rest of the assembly. Also, since the welding horn 78 is rigid and the rubberized nest is flexible, the nest 84 compresses at the area between the extensions **64*a* and 64*b***.

Figure 5:
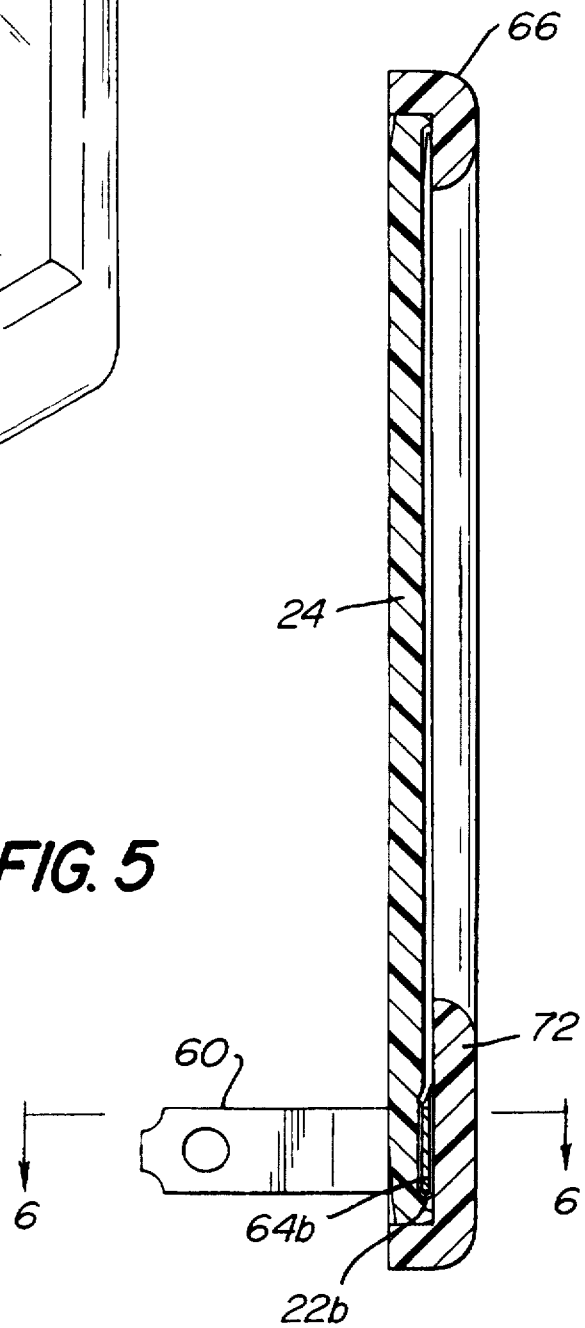
FIG. 5 is a sectional view of the electroluminescent device taken along line 5—5 of FIG. 1.

This compression allows a secure weld to occur at the bottom, top, and side ridges 30, 32, 34 and 36 and along the additional ridges 50, 52, 54 by creating an adequate welding surface as seen in FIG. 5. Also, when the ridges 50, 52, 54 are fused to the inner portion 72, they expand at their edges and abut against the extensions 64*a*, 64*b* to secure them in position. The thicker portion of the support plate 24 caused by the extension and pin assembly causes the support plate to become contoured in a convex manner immediately above the area between the extensions as seen in FIG. 6. The edges of the support plate 24 will actually be welded below the rear surface of the front part of the frame. This unique convex welding process and design allows the support plate to continuously put enough pressure on the pins, to provide a secure connection to the extensions without the use of added components or labor steps. In effect, force is applied in a converging directions to more area on the pin and extension assembly to prevent the pin and/or extension from moving apart. The welding process utilizes a welding tool 76 with a positive stop tolerance of 0.001 inches, air pressure of 30 p.s.i. with an error of 3 p.s.i, welding time of 0.55 seconds with an error of 0.05 seconds, and a hold of 0.2 to 0.3 seconds.

The advantages of the present invention include providing a multicolored design on an electroluminescent device and a secure electrical connection to the panel so that each pin and blade assembly is held in electrical contact by the convex contour of the portion of the support plate covering them.

While the preferred embodiment has been fully described and depicted for the purposes of explaining the principles of the present invention, it will be appreciated by those skilled in the art that modifications may be made thereto without departing from the scope of the invention set forth in the appended claims.

What is claimed is:

1. An electroluminescent device having a panel for displaying a design comprising:

a) a substrate coated with a first conductive layer which extends outwardly to the peripheral edges of said substrate;

b) a phosphor layer imprinted onto the surface of said conductive layer, said phosphor layer comprising a plurality of discrete multicolored characters;

c) a dielectric layer deposited onto said phosphor layer;

d) a second conductive layer deposited onto said dielectric layer;

e) a first elongated pin electrically connected to said first conductive layer; and f) a second elongated pin electrically connected to said second conductive layer.

2. The device of claim 1 wherein the first conductive layer (a) is a composition consisting essentially of a transparent metal oxide.

3. The device of claim 2 wherein said first conductive layer is indium tin oxide.

4. The device of claim 1 wherein said phosphor layer (b) is comprised of phosphor particles selected from the group consisting of zinc sulfide, zinc oxide, anthracene, naphthalene, butadiene, and acridine, alone or in combination.

5. The device of claim 1 wherein said second conductive layer is a composition consisting essentially of silver.

6. The device of claim 1 contained within a transparent, water impervious envelope.

7. An electroluminescent panel for simultaneously displaying a plurality of characters which comprises:

a) a first conductive layer deposited on a transparent substrate;

b) a plurality of phosphor films imprinted onto the surface of said first conductive layer;

c) a dielectric layer deposited on said phosphor films:

d) a second conductive layer superimposed on said dielectric layer;

e) a first elongated pin electrically connected to said first conductive layer; and f) a second elongated pin electrically connected to said second conductive layer.

8. The panel of claim 7 wherein said phosphor films are discrete characters.

9. The panel of claim 8 wherein said phosphor films are in a spaced apart relationship and together form a design.

10. The panel of claim 7 wherein each of said films are colored.

11. The panel of claim 7 wherein said substrate is a polyester film.

12. The panel of claim 11 wherein said polyester film is polyethylene terephthalate.

13. The panel of claim 7 wherein said first and second elongated pins are beryllium copper.

14. The panel of claim 7 wherein said phosphor films and said dielectric layer are contiguous.

15. The panel of claim 7 wherein said first conductive layer and said second conductive layer are in a co-planar spaced apart relationship and extend outwardly beyond the termini of said phosphor films and said dielectric layer.

16. In an electroluminescent device comprised of two electrically conductive layers between which is arrayed a laminate of electroluminescent phosphors and a dielectric, the improvement which comprises: arraying said phosphors as discrete films on a single layer which are in a spaced apart relationship to one another on said single layer so as to produce an illuminatable design comprised of discrete characters.

17. The device of claim 16 wherein each of said films are colored and produce a multi-colored design.

* * * * *